US010730673B2

(12) United States Patent
Hillmann et al.

(10) Patent No.: US 10,730,673 B2
(45) Date of Patent: Aug. 4, 2020

(54) CROWN CORK CLOSURE AND CLOSING METHOD

(71) Applicants: Heinz Hillmann, Obrigheim (DE); Andreas Krieg, Dittelsheim-Hessloch (DE)

(72) Inventors: Heinz Hillmann, Obrigheim (DE); Andreas Krieg, Dittelsheim-Hessloch (DE)

(73) Assignee: KHS GmbH, Dortmund (DE)

( * ) Notice: Subject to any disclaimer, the term of this patent is extended or adjusted under 35 U.S.C. 154(b) by 145 days.

(21) Appl. No.: 15/277,382

(22) Filed: Sep. 27, 2016

(65) Prior Publication Data

US 2017/0129668 A1 May 11, 2017

Related U.S. Application Data

(63) Continuation-in-part of application No. PCT/EP2015/056264, filed on Mar. 24, 2015.

(30) Foreign Application Priority Data

Mar. 27, 2014 (DE) ..... 10 2014 104 322

(51) Int. Cl.
*B65D 53/06* (2006.01)
*B65D 41/12* (2006.01)

(52) U.S. Cl.
CPC ..... *B65D 53/06* (2013.01); *B65D 41/12* (2013.01)

(58) Field of Classification Search
CPC ..... B65D 53/06; B65D 41/12
USPC ..... 215/328
See application file for complete search history.

(56) References Cited

U.S. PATENT DOCUMENTS

| | | | | |
|---|---|---|---|---|
| 2,974,816 A | | 3/1961 | Ford | |
| 3,261,895 A | | 7/1966 | Strickman | |
| 3,286,867 A | * | 11/1966 | Mumford | B65D 41/0442 215/321 |
| 3,514,004 A | * | 5/1970 | Hammersmith | B65D 41/12 215/328 |
| 8,381,914 B2 | * | 2/2013 | Hoffmann | B03D 1/02 209/12.1 |

FOREIGN PATENT DOCUMENTS

| | | |
|---|---|---|
| DE | 1018121 | 10/1957 |
| DE | 3515334 | 10/1986 |

(Continued)

*Primary Examiner* — James N Smalley
(74) *Attorney, Agent, or Firm* — Nils H. Ljungman & Associates

(57) ABSTRACT

A crown cork closure and closing method. The abstract of the disclosure is submitted herewith as required by 37 C.F.R. § 1.72(b). As stated in 37 C.F.R. § 1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

17 Claims, 14 Drawing Sheets

(56) References Cited

FOREIGN PATENT DOCUMENTS

| | | | | | |
|---|---|---|---|---|---|
| DE | 4018121 | | | 12/1991 | |
| DE | 4036306 | | | 6/1992 | |
| DE | 19713404 | | | 10/1998 | |
| DE | 102005004996 | | | 7/2006 | |
| DE | 102014010626 | | | 5/2015 | |
| FR | 351465 | A | * | 7/1905 | ..... B65D 41/12 |
| FR | 1317228 | | | 2/1963 | |
| GB | 860293 | A | * | 2/1961 | ..... B65D 41/12 |

* cited by examiner

CROWN CORK CLOSURE AND CLOSING METHOD

CONTINUING APPLICATION DATA

This application is a Continuation-In-Part application of International Patent Application No. PCT/EP2015/056264, filed on Mar. 24, 2015, which claims priority from Federal Republic of Germany Patent Application No. 10 2014 104 322.7, filed on Mar. 27, 2014. International Patent Application No. PCT/EP2015/056264 was pending as of the filing date of this application. The United States was an elected state in International Patent Application No. PCT/EP2015/056264.

BACKGROUND

1. Technical Field

The present application relates to a crown cork closure and closing method.

2. Background Information

Background information is for informational purposes only and does not necessarily admit that subsequently mentioned information and publications are prior art.

The present application relates to a crown cork closure system for containers, for example bottles or glass bottles. The closure system comprises on the inner side thereof, in the region of the shaped ends, a deformable sealing material. The deformable sealing material closes hollow spaces at least in the circumference of the end of the crown cork facing towards the container base.

Crown corks, also known as crown caps, are very common and well-known as closures for containers, for example for drinks bottles made of glass, for example for beer and soft drink bottles. In this situation, these crown corks comprise a circular sheet piece with an edge bent in a crown shape, and a sealing insert. The sealing insert was initially made of cork, which as a compressible intermediate piece provided for the necessary and/or desired sealing tightness between the neck of the bottle and the sheet piece. Nowadays, polyvinylchloride (PVC) or polyethylene (PE) is usually used. In addition, for reasons of protection against corrosion, crown corks are, as a rule, coated with protective lacquers.

The most frequently used type of crown cork has twenty-one prongs, wherein the desirability of the odd number of prongs lies in the fact that they do not stand directly opposite one another, and therefore tilting in the delivery devices is prevented or minimized.

Crown corks are placed onto the containers by means of a closure machine, which, with the aid, for example, of a magnetic punch, guides the crown corks that are delivered and presses them onto the necks of the bottles. At the same time, a cylindrical section lowers down around the crown cork, which essentially ensures or promotes that the jagged edge is bent over, or is seamed around the mouth region of the container.

In some methods for closing containers, crown corks are closed onto the mouth region of a container with the formation of a sealing pressure seat between the closure element and the container. In a first closing phase, a temporary clamp connection is produced, and in a subsequent closing phase, the final sealing pressure seat is produced. In this situation, the temporary clamp connection of the closure element with the container is produced by plastic deformation of the crown cork. Some closure processes comprise, in this situation, a plurality of steps with different, i.e. increasing, closure force. A further crown cork closure system may include a tacking head, which comprises movable pin elements for seaming around the crown cork edge. In this situation, a pneumatic drive device is provided for producing a thrust movement for the tacking head.

In some hygienic devices, the closure of the container takes place in a sterile chamber, which sterile environment is produced by a protective gas.

Even if the method and devices usual for this purpose are in wide use, a problem lies in the fact that, during the filling process, the container mouth is frequently wetted with the product directly before the closing device. Wetting of the container mouth can possibly cause contamination in the hollow space which is present beneath the crown cork teeth which have been positioned and seamed, inasmuch as mold formation takes place. In any event, the spaces beneath the crown cork form a partially open hollow space, in which dirt contamination cannot be avoided. Such contamination is especially undesirable since when a consumer drinks from the bottle, his lips and mouth will come in contact with that area.

OBJECT OR OBJECTS

An object of the present application may comprise providing a crown cork closure device or system which exhibits improved hygienic properties.

SUMMARY

This object may be solved according to the present application with a crown cork closure device or system which comprises, on the inside in the region of the shaped ends, a deformable sealing material, which closes the hollow spaces at least in the circumference of the end facing the container base.

With such a cap-like closure system for containers, crown corks are provided which comprise a plurality of prong-like or tooth-like shaped ends, as alternating elevations and depressions or valley sections. These are, in general, of an odd number, in order to avoid, restrict, and/or minimize blockages on the transport paths. These crown corks are formed at least partially from a metallic material and/or a material containing aluminum (main part), and can comprise an inner coating of one or more layers (rubber, plastic) to improve the sealing effect between the container mouth and the underside of the crown cork. The crown cork is shaped in such a way that the shaped ends, after the specified deformation for closing the mouth of the container, exhibits a corrugated or jagged radial contour. The contour is such that one or more hollow spaces are formed between the outer container surface, which is close to the mouth, and the shaped ends. According to the present application, a deformable sealing material is provided in the region of the shaped ends, which sealing material closes and/or fills up the hollow spaces. In this situation, the hollow space closure does not need to be complete in the axial direction, but at least in the circumferential direction a rim or ring-shaped closure or sealing element is achieved.

The sealing material is adhesively bonded onto the main part of the crown cork, or can be pressed on or secured in some other suitable manner. This merging of the sealing material and the main part of the crown cork can take place immediately or substantially immediately upstream of the closure device or in the closure device. The main part of the crown cork and the sealing material are provided from two different storage systems and delivery or transfer systems, and, before the application onto the bottle, are connected to form one single closure or crown cork.

In order to be as universally usable as possible, the sealing material is introduced into the blank of the main part. In at least one possible exemplification, the sealing material is located in the valley regions of the jagged portion of the crown cork on the inside surfaces which are close to the edge. The sealing material, in one possible exemplification, is located completely within the valley regions and does not project above the elevated sections or peaks adjacent the bottle. In another possible exemplification, the sealing material in the valley regions slightly projects or extends beyond and/or over the elevated sections or peaks. In at least one possible exemplification, the sealing material should not project above the main part in the region of the elevations or peaks on the inside perpendicularly or substantially perpendicularly by any more than one millimeter. In another possible exemplification, the material projection of the sealing material should be in the range from zero to one-half millimeter, and, in yet another possible exemplification, in the range of less than one-fifth millimeter.

Such small projections, or the absence thereof, of sealing material on the inside of the main part of the crown cork essentially prevent, restrict, and/or minimize a shearing effect during placement and closure by the conventional closure tools. In other words, since there is either very little or no sealing material on or over the interior peaks of the crown cork, the sealing material will essentially not be scraped off or displaced by contact with the outer surface of the bottle during placement of the crown cork on the bottle. In addition, this design permits a secure placement of the main part, without a larger geometry or otherwise changed design of the main part being necessary and/or desired.

It should be noted that the inner side or interior of the main part is considered to be that side which, when in the specified position, faces in the direction of the container mouth, or is in contact there. Accordingly, the outer side of the main part is the corresponding other side of the main part, and regularly bears, in at least one possible exemplification in the central region, a decor, a script section, and/or a logo for notification for end users.

The sealing material can, in at least one exemplification, be a rubber or foam-type material. In at least one other exemplification, the rubber or foam-type material has an outer surface that comprises, in relation to the inner surface, no or essentially no pores, in order to render the lodging of impurities more difficult. In this situation, a germicidal or proliferation-inhibiting content substance can be added to the sealing material, such as silver, zinc, or copper particles or other permissible substances.

In at least one possible exemplification, the sealing material is formed as a disk or plate-type shaped piece in the form of a sealing pad, which comprises at least two more or less concentric regions. The one region is the radially outer region or edge region, which is shaped as a beading-like rim contour or seal contour. This can be contoured in a suitable manner to the shaped ends, i.e. it can also exhibit a tooth-like structure. The inner region forms the flatter middle part, which forms the mouth sealing on the upper side of the container. This can, if appropriate, comprise a contact surface or contouring which matches to the container mouth, and thus functions as a mouth seal or sealing structure.

The sealing pad can be connected to the main part itself, or be or become attached to it, such as before the closure of the container, in such a way that the sealing pad is in full surface contact on the main part, i.e., is fixed in position, for example by adhesive bonding. As an alternative, provision can be made for a part surface of the inner and/or the outer region to be fixed in position on the main part, such that an expansion or a movement in the material of the sealing pad is easily possible, in order to achieve an optimum sealing position.

In at least one possible exemplification of the present application, a sealing material is used which is an activatable material with regard to volume. In this application, the term "activatable" is to be understood hereinafter to mean that the sealing material, before or at the introduction of the main part, or of the cap-shaped closure system, exhibits a first state form and/or first volume size or expansion. By force changing and/or the application of energy to the sealing material, a change to a second state form and/or a second volume size or expansion can be incurred. Accordingly, the crown cork, which includes a lesser volume of sealing material, can be stored and transported as loose material with a saving of space, and, in at least one possible exemplification, without damage to the softer sealing material. In other words, the sealing material can be kept in a compressed or unactivated state so that it takes up less volume in storage and protects the sealing material from damage since less of the sealing material is exposed. The desired volume enlargement and/or redistribution for essentially ideal or desired closure of the undesirable hollow spaces is carried out after the mechanical deformation of the crown corks and the closing of the containers. As an alternative, however, this activation and enlargement can also take place on the delivery path of the crown cork to the container, if this is already present in an at least partially predetermined position and/or orientation. In other words, the sealing material can be activated to cause an expansion of the sealing material, either before, during, or after placement of the crown cork on the bottle.

In at least one exemplification, activation takes place by the application of thermal energy, in that the sealing material expands and/or melts under the influence of heat, such that a spatial redistribution takes place, which results in the filling of capillaries and hollow spaces. In this situation, the main part of the crown cork can be heated by contact heating, radiators, or inductive heating, such that, by the introduction of heat, the sealing material is indirectly heated.

In one possible exemplification, glass bottles are closed that are cold after filling due to the temperature of the filling product, which temperature can be in a temperature range of less than fifteen degrees Celsius, or possibly less than ten degrees Celsius. In such a situation, the heat to activate the sealing material can be introduced in a very limited region, such as from vertically above, into the material of the crown cork, namely the section covering over the mouth opening of the container. In this manner, very little to no heat is introduced into the surface of the container, and, in at least one possible exemplification, the sealing material also serves as thermal insulation.

As an alternative, the sealing material can exhibit what is referred to as a "memo effect" or "memory effect," such as exhibited by memory foam. Such sealing material comprises a compressed, reduced volume form after pressure reduction is retained for a time, while the original enlarged volume form is slowly regained. The volume reduction can take place in such a way that the sealing material of the crown corks is compressed briefly in the delivery feed to the container, or the crown corks and the sealing material are kept stored under compression or pressure, such that the volume reduction is already incurred in the sorting and feed delivery system to the closure system. Here, for example, reference may be made to materials made from a polyurethane or materials comprising polyurethane. The reforming process can be supported or accelerated in a comparable manner as described heretofore. In other words, the sealing material can be made from a material that can be compressed from an original volume/shape into a smaller volume/shape by force, but which material, after the compressing force is terminated or released, generally slowly returns to its original volume/shape over a period of time.

In a further possible exemplification the sealing material comprises one or more applications of a hot and/or melt adhesive, which, after the deforming and closing is partially melted by a suitable application of energy. In this situation, in one possible exemplification, a melt adhesive can be provided for, which, before the heating referred to heretofore, is softer and more elastic than after the melting or embrittlement or hardening. The result is that the opening of the crown cork or the container causes a kind of break in the adhesive, which, in one possible exemplification, can be easily perceived visually by the user as evidence of possible improper opening or tampering, and/or possible contamination of the product in the container.

At least one possible exemplification of the cap-type closure system of the methods referred to heretofore comprises the sealing material projecting radially over the shaped ends, such that this free sealing material forms a kind of securing ring or rim. When the container is opened by a user or consumer, this ring or rim of sealing material must be or should be or could be damaged because, for example, it is partially deformed, fragmented, and/or split. Accordingly, the sealing material also serves as security against interference and proof of hygiene. The hygiene can be further improved if the sealing material contains, at least in some areas, germicidal or germ-retardant substances, such as, for example, silver or copper compounds or other known chemicals.

In this situation, it is additionally possible for the sealing material to be worked in, at least in some areas, such that the sealing material in these areas or overall hardens or embrittles more intensely. Such a working in effect can be achieved, if appropriate, by means of ultraviolet (UV) radiation, further energy application, cold shock, or in some other suitable manner.

In one variant, the sealing material contains, for example, components which can be cured by means of UV radiation. In this situation, a chemical reaction takes place during the curing by way of UV polymerization. Specifically, photoinitiators are provided in the sealing material, or, if appropriate, in the peripheral area, which in the initial form are present in a double bond. If UV radiation is applied by means of radiating devices, the photoactivators are activated, wherein, due to the energy-rich UV radiation, the double bonding of the photoinitiators is broken open, such that free radicals form, and an irreversible cross-linking takes place with, for example, filling and binding agents, to form macromolecules. This results in hardening and embrittlement.

Accordingly, in at least one possible exemplification, a method for the closing of containers with a cap-type closure system can also comprises a reforming and/or activation step which follows after the step of the deformation of the shaped ends. In the reforming and/or activation step, a change of form and/or of state of the sealing material can be caused, at least intermittently, by pressure relief or indirectly by energy application in the crown corks, or directly by energy application into free-lying surfaces of the sealing material. This results in a volume enlargement of the sealing material, with which the hollow spaces are closed.

At least one possible exemplification comprises an arrangement with which, after the deformation and activation of the sealing material, the sealing material projects axially outwards over the free shaped ends with a ring or rim-shaped area. By way of the activation and/or by way of an additional treatment step, the projecting free sealing material is enlarged in such a way, in one possible exemplification also in the radial direction, that it covers the edges of the crown cork facing axially downwards. Consequently, a ring or rim is formed underneath the free shaped ends, which essentially ideally may have the same or a larger outer circumference than the largest outer circumference of the shaped ends in the deformed closure state.

A further exemplification with a view to the avoidance of possible mechanical damage comprises the outer valley sections of the closure element being filled wholly or partially with a flexible filling material. In this situation, this filling material should not project over the elevated teeth, in order not to be pushed off by the closure tool during the deformation of the main part. This filling material could be an analogous material to the sealing materials referred to heretofore, and, in one possible exemplification, likewise be activatable.

As an alternative or in addition to this, it is also possible for the radially outer edges of the main part to be occupied by an edge material, such as, for example, a sealing lacquer or a hot or melt adhesive. This edge material forms a visually desirable mechanical protective rim on the under edge of the main part after application onto a container. By means of subsequent heat treatment, in an analogous manner, the edge protection can be smoothed and undergo final treatment as security against improper opening or tampering.

For the machine-side realization of the exemplifications described heretofore, the corresponding devices, such as heating elements, radiator devices, compressors, etc., are provided, which are arranged in a suitable manner. For the heating or irradiation, which, if appropriate, can be of very small surface areas, appropriate laser and/or lens systems may also or alternatively be provided.

Accordingly, for example, for the melting of a melt adhesive after the closure, energy-rich lasers are suitable, which are directed obliquely from below onto free surfaces of the adhesive application, and/or which are directed radially onto the region of the shaped ends, under which the adhesive agent application is arranged.

The otherwise known process steps before and after the closure system can be combined in an analogous manner as required and/or desired. These are suitable inspection and monitoring units upstream and/or downstream of the closure system, cleaning and hygiene units, in order to remove impurities by suction extraction, and, if appropriate, to carry out disinfection of the closures. In at least one possible exemplification, a closure inspection arrangement may be provided after the closure system, which inspects the proper closure quality and the presence of the crown cork and, if appropriate, the security rings which have been produced beneath the crown cork.

As the delivery systems, known units are used, which transport the closures to the closure system, and in this situation take account of the orientation and location and secure them. The desired direction orientation is retained in such transport units. Additionally, the transfer of the crown corks to the closure system takes place by way of pick and place station(s), by way of blower devices, or other suitable elements.

If required and/or desired, a mouth shower or blower or flushing arrangement can be provided before the actual closure step, in order, for example, to flush away foam residues.

The closure system itself comprises known closure heads, which can apply the crown corks described. The closure system is possibly a closure system in circulating design, with a plurality of closure stations, which in each case comprise at least one closure tool. An alternative comprises the closure tool, by means of which the main part is formed onto the container mouth and closes it, serves as a thermal energy conductive or transfer element, in that it is formed, for example, for inductive heat transfer or is itself inductively heated.

With an alternative exemplification, the energy application (in one possible exemplification the thermal energy application) is additionally or solely in a treatment station, which is arranged downstream of the closure system, wherein the means for the energy application correspond to the means referred to heretofore. For uniform energy application, in at least one possible exemplification, the containers which are to be treated are rotated, during the transport on the treatment path, about an upright axis, wherein the closure and the container mouth lie free. The devices for the energy transfer, for example heating elements, radiator devices, etc. can be arranged, for example, next to the transport path of the containers.

If the containers are surrounded, for example, by an energy-dispensing gripper, a rotation is not required and/or desired. Accordingly, the activation of the sealing material could possibly take place on an outlet transporter, in one possible exemplification an outlet star with suitable heatable head and mouth grippers.

In this situation, a hardening and/or embrittling unit may be provided downstream of the closure position, although this can also be an integral constituent part of the closure station, which can be activated, i.e. switched on, as required and/or desired.

The present application relates to a cap-like closure system for containers (crown cork) which comprises a plurality of prong-like or tooth-like shaped ends. Said crown corks are at least partially made from a metallic and/or aluminum-containing material (main part) and can have an inner coating comprising one or more layers (rubber, plastic) for the purpose of improving the seal between the container mouth and the underside of said crown cork. The crown cork is shaped such that after the appropriate forming process to close the mouth of the container, the shaped ends display the generally-known corrugated or jagged radial contour such that one or more hollow spaces are formed between the outer container surface that is close to the mouth, and said shaped ends, a deformable sealing material being provided in the region of said shaped ends and closing these hollow spaces. The closure of the hollow spaces does not have to be complete in the axial direction, however a circular or ring-shaped closing or sealing element is obtained at least in the circumferential direction.

The above-discussed exemplifications of the present invention will be described further herein below. When the word "invention" or "exemplification of the invention" is used in this specification, the word "invention" or "exemplification of the invention" includes "inventions" or "exemplifications of the invention", that is the plural of "invention" or "exemplification of the invention". By stating "invention" or "exemplification of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EXEMPLIFICATION OR EXEMPLIFICATIONS

Figure 1:
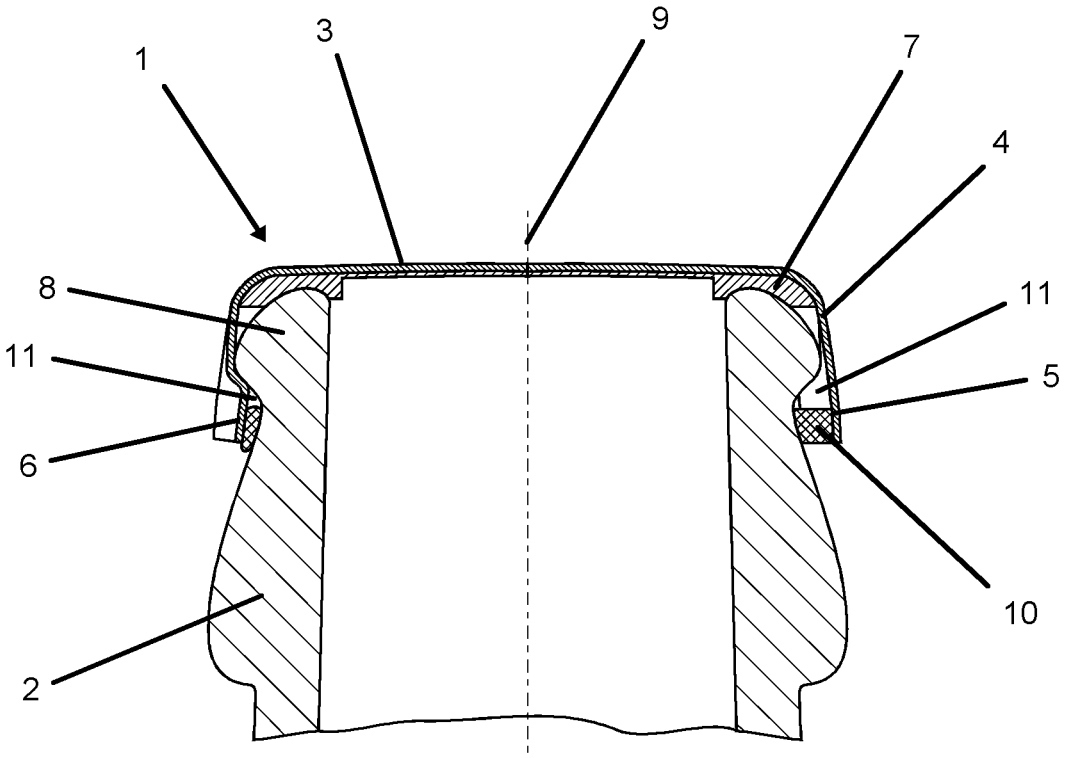
FIG. 1 shows a cross-sectional view of the top or mouth portion of a bottle with a crown cork or crown cap according to one possible exemplification.

FIG. 1 shows a cross-sectional view of the top or mouth portion of a container, specifically a bottle 2 having a longitudinal axis 9, with a crown cork or crown cap 1 according to one possible exemplification. The crown cork 1 includes a disk-shaped main portion 3 and a substantially ring-shaped or annular edge portion 4. The edge portion 4 is corrugated or jagged such that the edge portion 4 has alternating peaks 5 and valleys 6. The peaks 5 are further from the surface of the bottle 2 than the valleys 6. The crown cork 1 also has a seal 7 that seals the top of a lip portion 8 of the bottle 2. The bottle 2 is contoured such that the outer surface curves inwardly from the lip portion 8. The edge portion 4 of the crown cork 1 is deformed or clamped around the lip portion 8 to secure the crown cork 1 to the bottle 2. However, hollow spaces 11 are formed between edge portion 4 and the surface of the bottle 2, specifically in the vicinity of the peaks 5 and valleys 6. Liquids and/or dirt and/or other contaminants could become trapped in the hollow spaces 11, which could result in dirtying of the container, buildup of hazardous contaminants, or possible contamination of the product therein. As discussed herein above, a sealing material 10 is located in the lowermost part of the edge portion 4, adjacent or at the edge of the edge portion 4, to seal off the hollow spaces 11 from the outside environment. The sealing material 10 in FIG. 1 only fills a portion of the volume of the hollow spaces, rather than the entire volume, such that there is still an open space between each of the peaks 5 and valleys 6, that is, between the interior surface of the edge portion 4 and the outside surface of the container 2. It should be noted that there is hollow or open space around the entire circumference of the container mouth portion below the lip portion, as seen in FIG. 1.

Figure 1A:
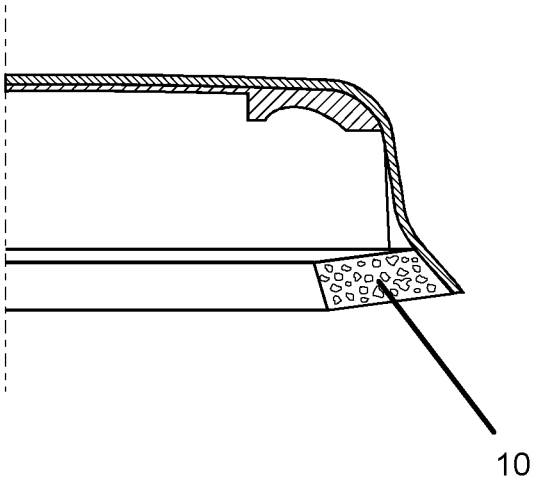
FIG. 1A shows a cross-sectional view of a portion of a crown cork or crown cap according to one possible exemplification.

FIG. 1A shows a cross-sectional view of a portion of a crown cork or crown cap according to one possible exemplification. The sealing material 10 is a rubber-type or foam-type material, in one possible exemplification a rubber-type or foam-type material of which the outer surface comprises no or essentially no pores in relation to the inner surface.

Figure 1B:
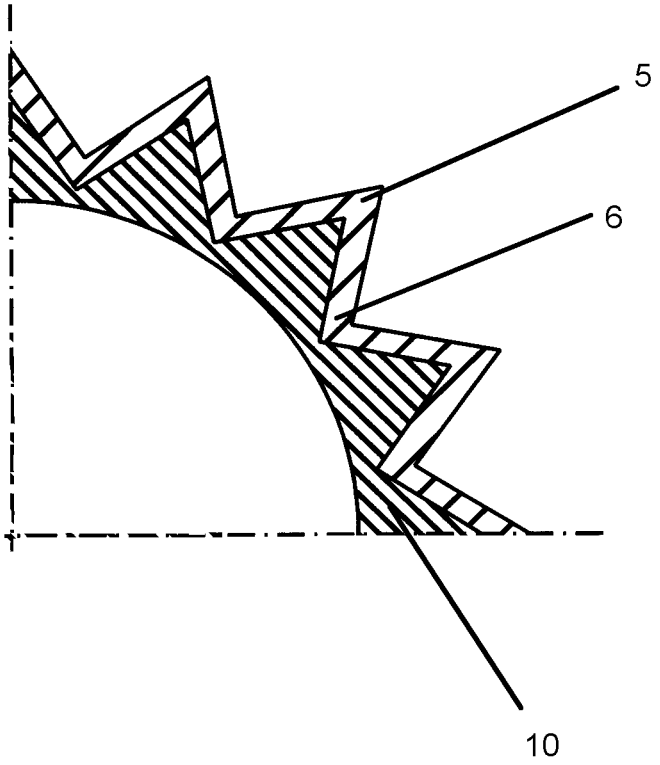
FIG. 1B shows a cross-sectional view, as viewed along the longitudinal axis of the container, of a portion of container with a crown cork or crown cap according to one possible exemplification.

FIG. 1B shows a cross-sectional view, as viewed along the longitudinal axis 9 of the container 2, of a portion of container 2 with a crown cork or crown cap 1 installed thereon according to one possible exemplification. The corrugated or jagged design of the edge portion 4, with alternating peaks 5 and valleys 6, is shown. In FIG. 1B, the sealing material 10 is in sealing contact with both the edge portion 4 and the surface of the container or bottle 2. In FIG. 1B, the sealing material 10 forms a complete seal all around the perimeter of the container 2.

Figure 2:
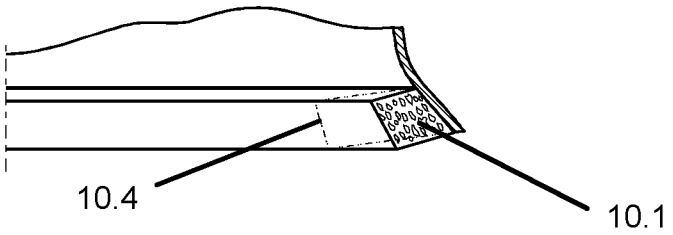
FIGS. 2, 2A, 2B, and 2C show a cross-sectional view of a portion of a crown cork or crown cap according to one possible exemplification.
Figure 2A:
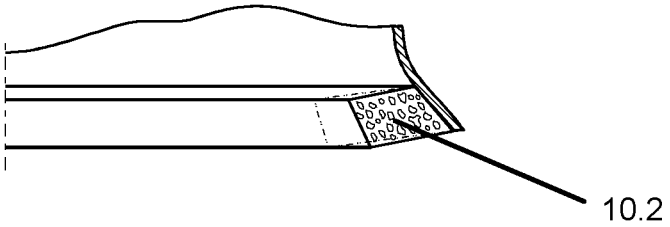
Figure 2B:
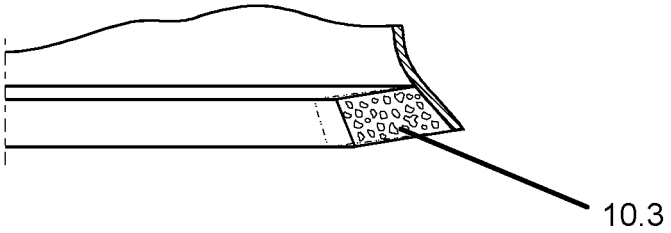
Figure 2C:
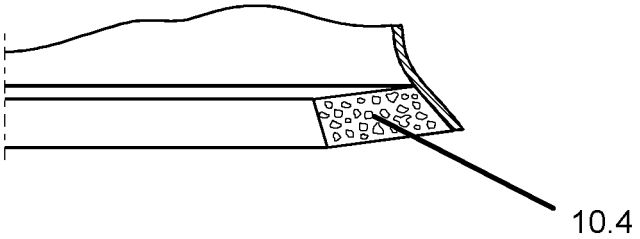

As discussed above, the sealing material 10 can be a material that can change in volume or state by changing the force applied to the material and/or applying energy, such as thermal energy, to the material. The sealing material 10 can be kept in a compressed or unactivated state until the time for installation on a container. FIGS. 2, 2A, 2B, and 2C show a cross-sectional view of a portion of a crown cork or crown cap according to one possible exemplification, in which the sealing material 10 is made from a material that can change in volume. Specifically, the sealing material 10 can exhibit what is referred to as a "memo effect" or "memory effect," such as exhibited by memory foam. In FIG. 2, the sealing material 10 is in a compressed state 10.1. However, the sealing material 10, prior to compression, had an uncompressed state or volume 10.4, shown in dotted lines. FIGS. 2, 2A, 2B, and 2C show the progression from the compressed state 10.1, to a less compressed state 10.2, to an even less compressed state 10.3, and finally the original, uncompressed state or volume 10.4.

Figure 3:
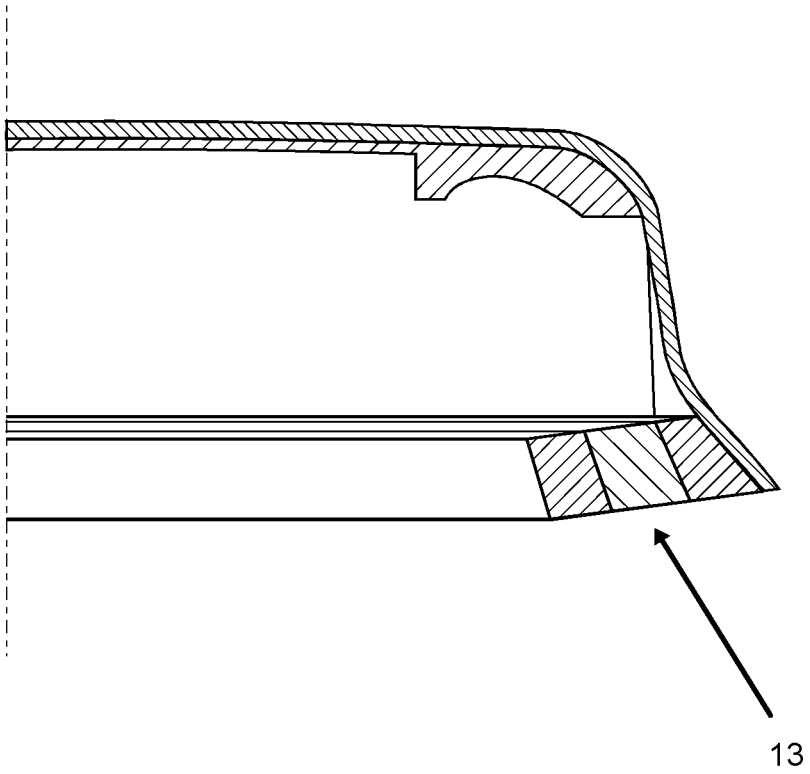
FIG. 3 shows a cross-sectional view of a portion of a crown cork or crown cap according to one possible exemplification.

FIG. 3 shows a cross-sectional view of a portion of a crown cork or crown cap according to one possible exemplification. The sealing material in FIG. 3 is a hot adhesive or melt adhesive 13.

Figure 4:
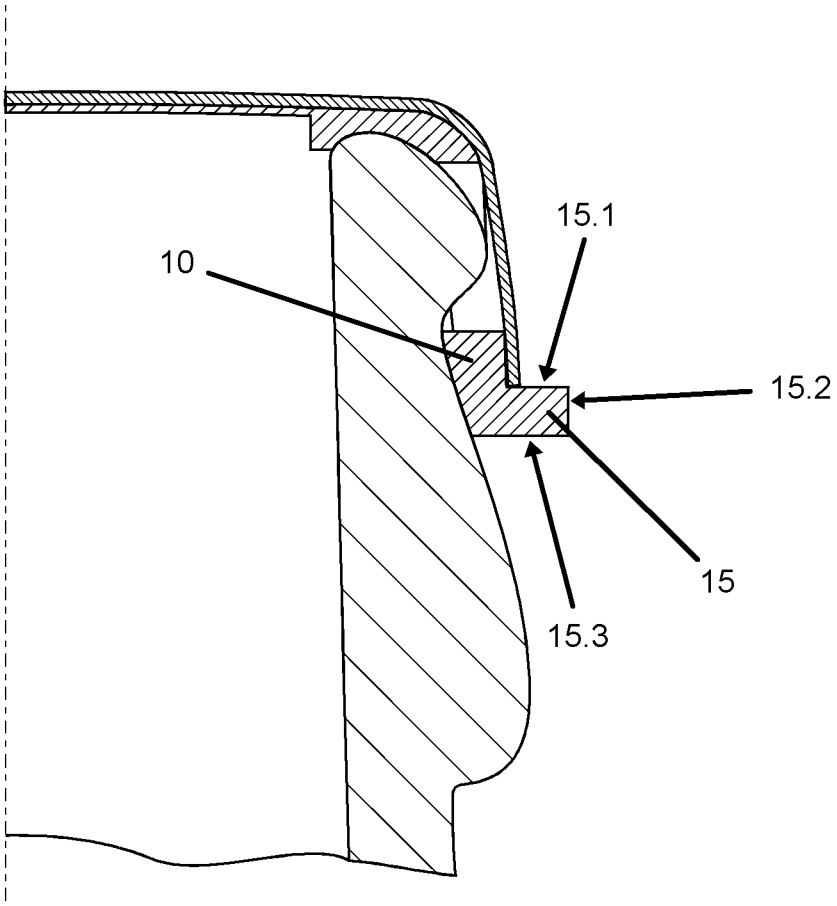
FIG. 4 shows a cross-sectional view of a portion of the top or mouth portion of a bottle with a crown cork or crown cap according to one possible exemplification.

FIG. 4 shows a cross-sectional view of a portion of the top or mouth portion of a bottle with a crown cork or crown cap according to one possible exemplification. In this exemplification, a portion 15 of the sealing material 10 projects radially outward, with respect to the longitudinal axis 9, beyond the lowermost edge of the edge portion 4. The portion 15 extends out such that there exposed outer surfaces of the portion 15, such as an exposed top surface 15.1, an exposed side surface 15.2, and an exposed bottom surface 15.3. In contrast, in FIG. 1, the sealing material 10 only has an exposed bottom surface since the sealing material 10 does not extend past the lowermost edge of the edge portion 4 as in FIG. 4. The sealing material 10 in the exemplification in FIG. 4 is therefore easily visible and can serve as an indicator of whether or not the crown cork 1 has been prematurely dislodged or loosened or opened due to accidental or intentional tampering.

Figure 5:
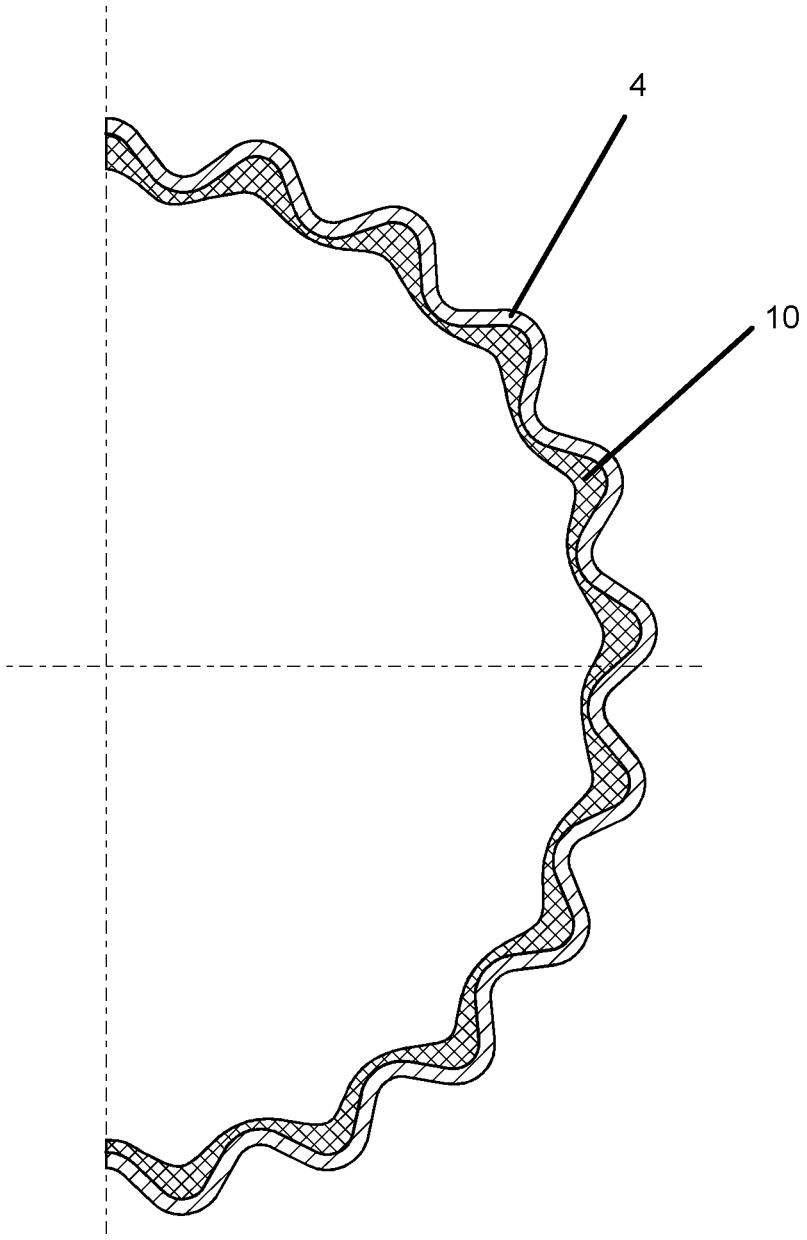
FIG. 5 shows a cross-sectional view, as viewed along the longitudinal axis of the container, of a portion of a crown cork or crown cap according to one possible exemplification.

FIG. 5 shows a cross-sectional view, as viewed along the longitudinal axis of the container, of a portion of a crown cork or crown cap according to one possible exemplification. In this exemplification, the thickness of the sealing material 10 is such that the sealing material 10, in a direction perpendicular to the longitudinal axis 9, projects past the main part 3 by either a very small amount of less than one millimeter or less than 0.5 millimeter, or not at all, i.e., zero millimeters.

Figure 6:
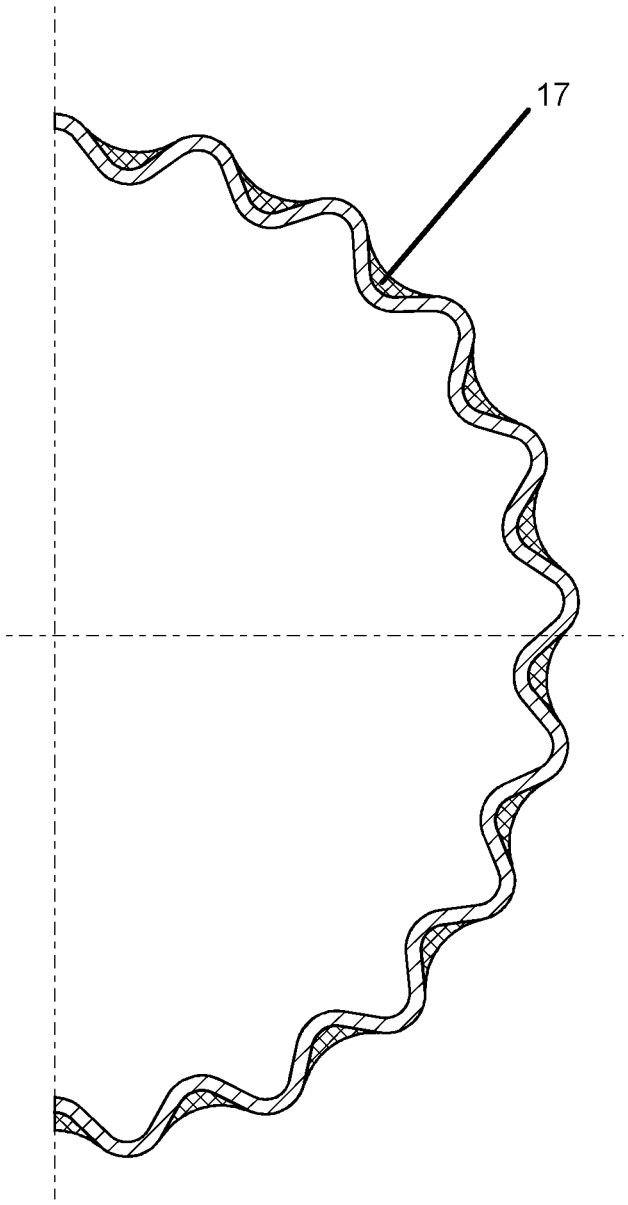
FIG. 6 shows a cross-sectional view, as viewed along the longitudinal axis of the container, of a portion of a crown cork or crown cap according to one possible exemplification.
Figure 7:
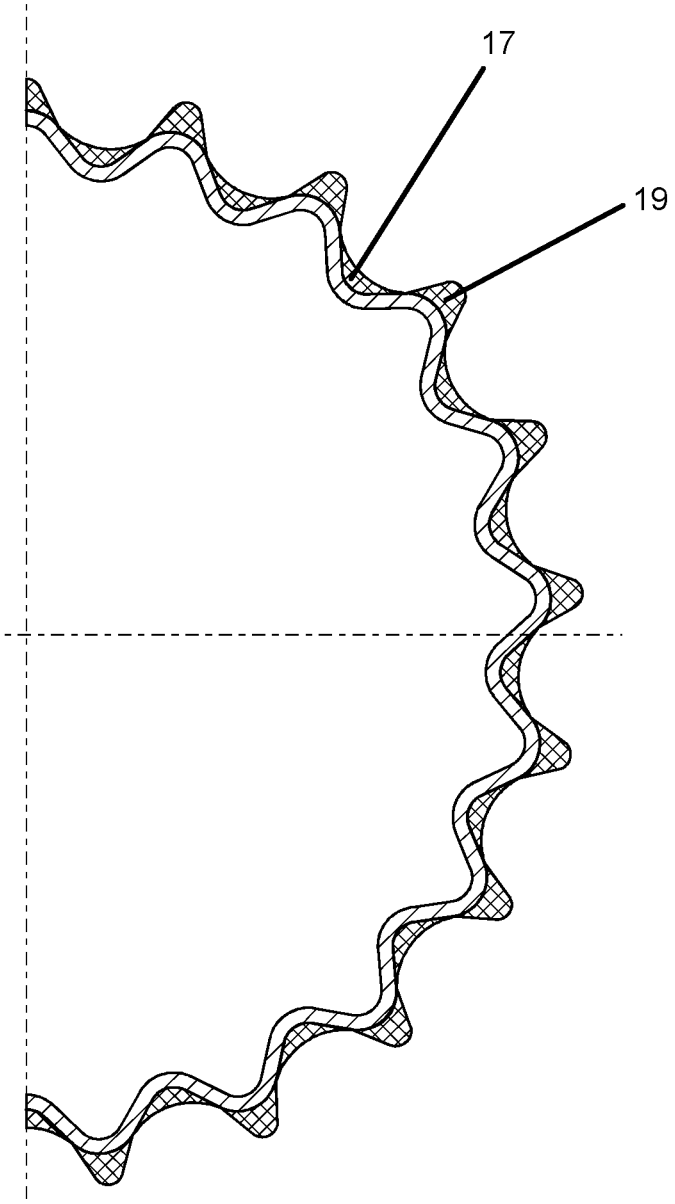
FIG. 7 shows a cross-sectional view, as viewed along the longitudinal axis of the container, of a portion of a crown cork or crown cap according to one possible exemplification.
Figure 8:
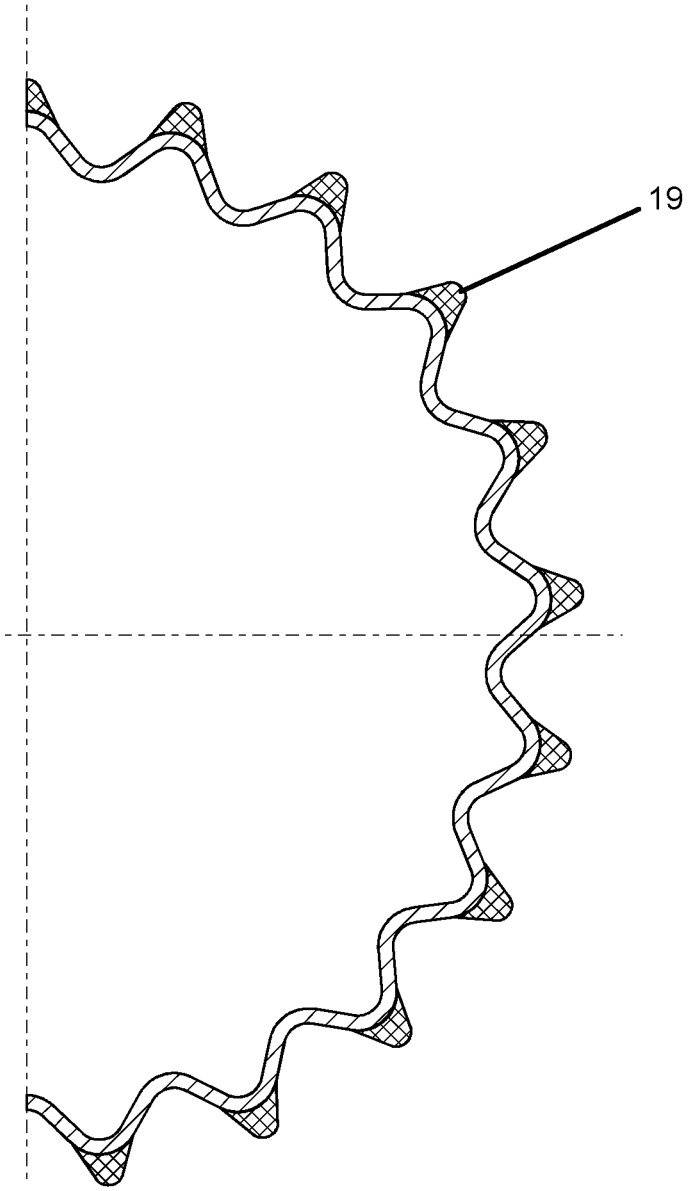
FIG. 8 shows a cross-sectional view, as viewed along the longitudinal axis of the container, of a portion of a crown cork or crown cap according to one possible exemplification.

FIG. 6 shows a cross-sectional view, as viewed along the longitudinal axis of the container, of a portion of a crown cork or crown cap according to one possible exemplification. In this exemplification, valleys 6 of the edge portion 4 are at least partially filled with a filling material 17. FIG. 7 shows a cross-sectional view, as viewed along the longitudinal axis of the container, of a portion of a crown cork or crown cap according to one possible exemplification. In this exemplification, the valleys 6 of the edge portion 4 are at least partially filled with a filling material 17, and at least a portion of the peaks 6 of the edge portion 4 are covered with an edge material 19, such as a coating, lacquer, or other material. FIG. 8 shows a cross-sectional view, as viewed along the longitudinal axis of the container, of a portion of a crown cork or crown cap according to one possible exemplification. In this exemplification, only at least a portion of the peaks 6 of the edge portion 4 are covered with the edge material 19.

Figure 9:
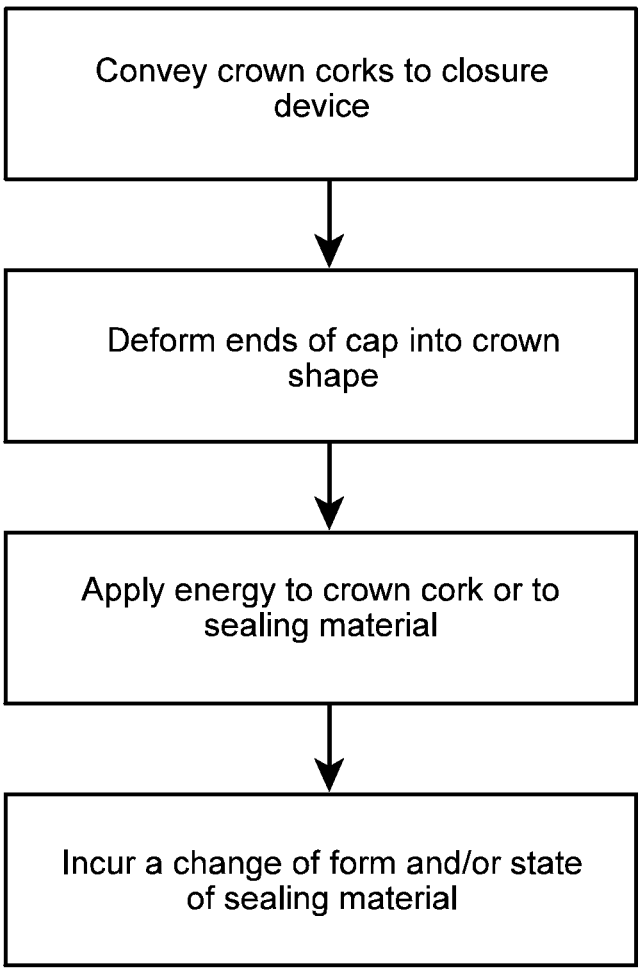
FIG. 9 shows steps of a method according to one possible exemplification.

FIG. 9 shows steps of a method according to one possible exemplification. As discussed herein, containers can be closed with a crown cork or crown cap closure system or structure. The containers and the crown corks are first conveyed to a closure device or closing machine. In the closure device, the edge portion of the crown cork is deformed or shaped into a crown shape. After the deformation, an activation step is performed, in which energy is applied to the sealing material, either indirectly by energy application into the crown cork, or directly by energy application into free-lying or exposed surfaces of the sealing material. The application of energy results in an at least intermittent change of form and/or state of the sealing material.

Figure 10:
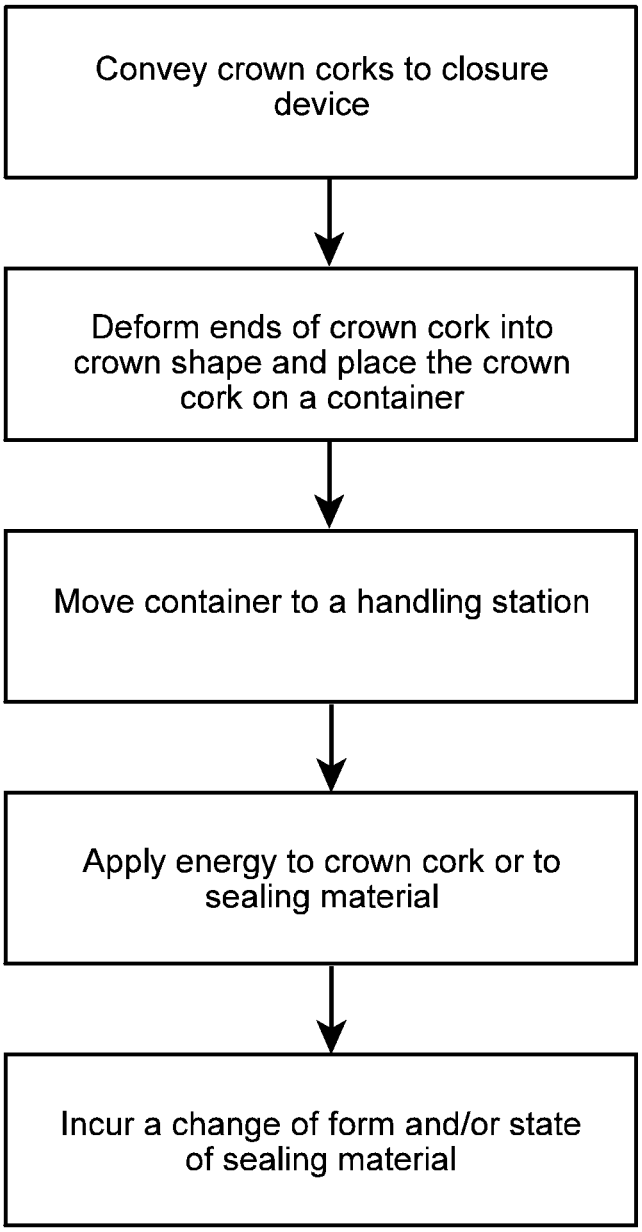
FIG. 10 shows steps of a method according to one possible exemplification.

FIG. 10 shows steps of a method according to one possible exemplification. Instead of the energy application taking place in the closure device as shown in FIG. 9, the energy application takes place in a transport and/or handling station downstream of the closure device. This energy application can take place during a continuous transport of the containers.

According to one possible exemplification, when the change of form and/or state of the sealing material takes place, after the deformation and after the activation, a projecting portion of the sealing material covers the free shaped ends of the crown cork in the radial direction, and therefore forms a ring or rim beneath the free shaped ends.

Figure 11:
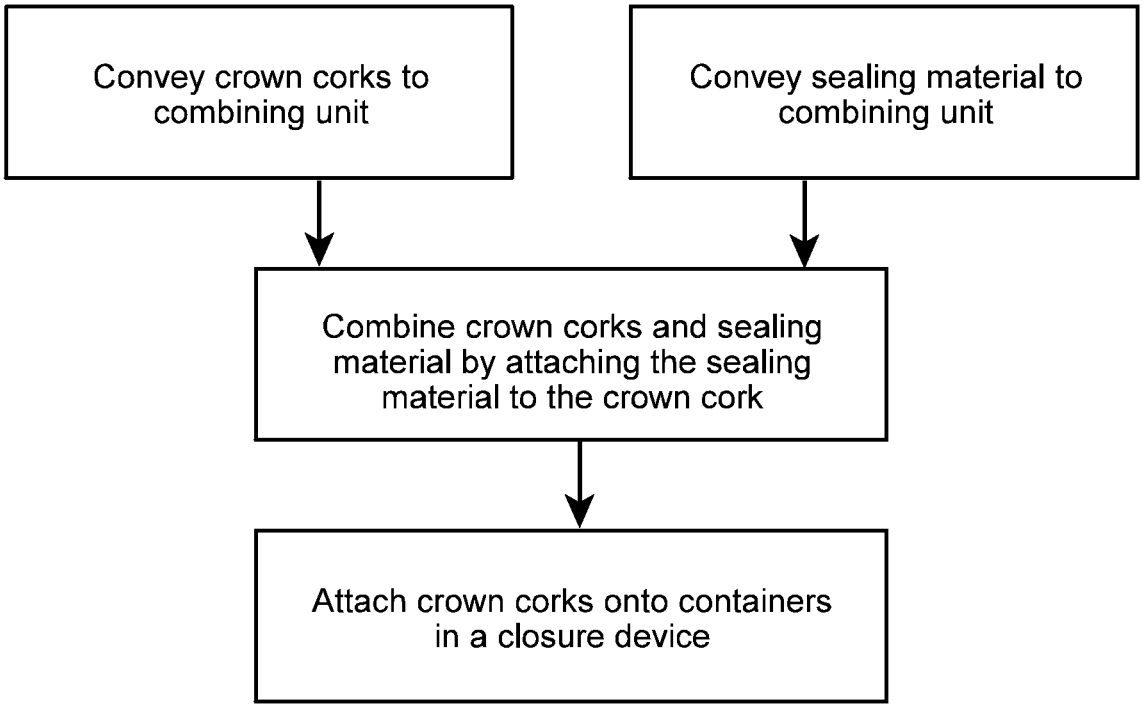
FIG. 11 shows steps of a method according to one possible exemplification.

FIG. 11 shows steps of a method according to one possible exemplification. As discussed herein, the sealing material is attached to the main part of the crown cork by adhesive bonding, pressing on, or securing in an otherwise suitable manner. According to the exemplification shown in FIG. 10, the step of bringing together the sealing material and the main part takes place directly upstream or in the closure system. Specifically, the main part and the sealing material are provided from two different material-holding and storage units. They are then conveyed via corresponding feed and transfer systems respectively to a combining unit. At the combining unit, the sealing material is attached to the crown corks, before the application onto the respective container, to form one single closure structure or crown cork.

Figure 12:
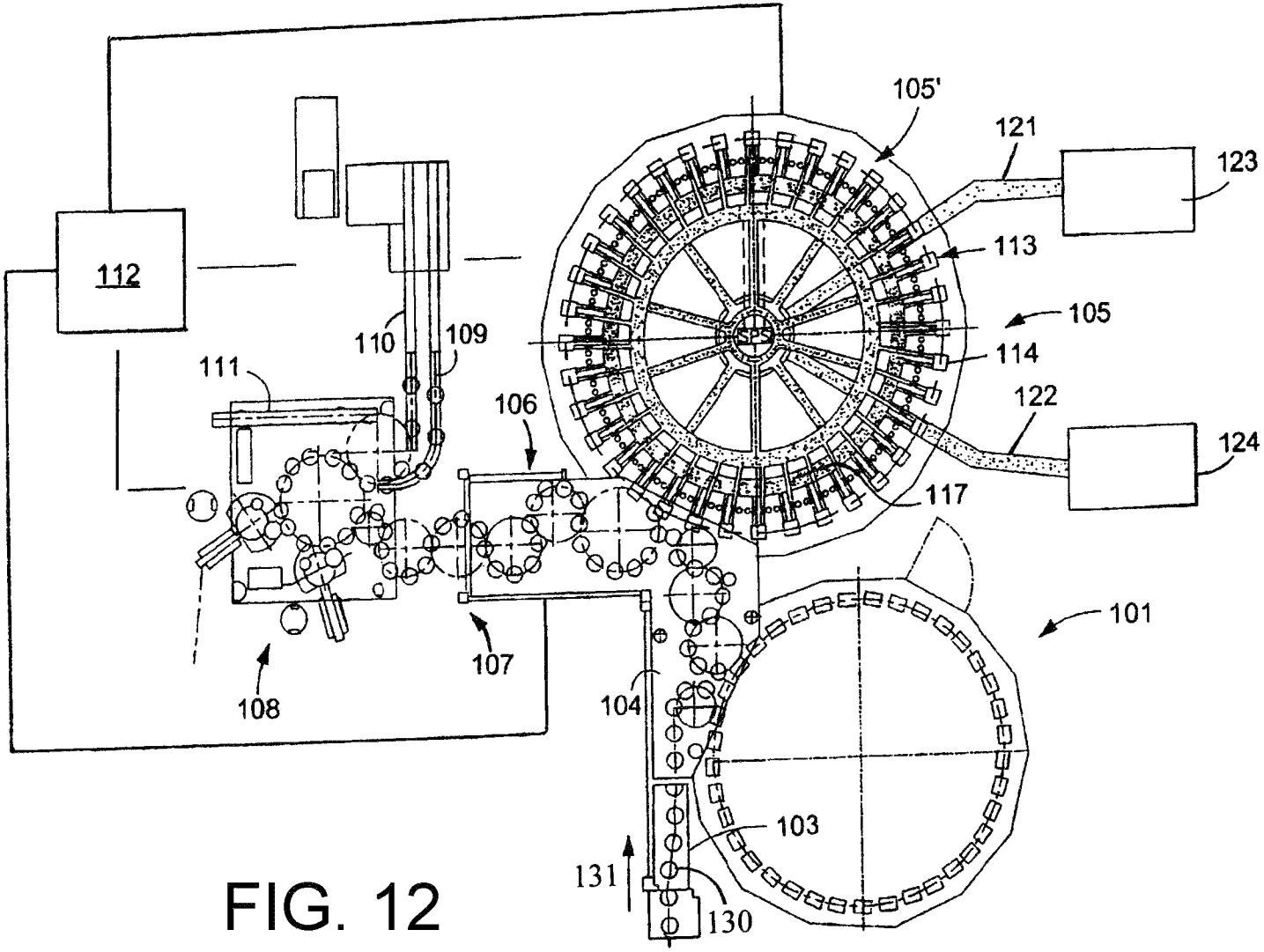
FIG. 12 shows schematically the main components of one possible example of a system for filling containers.

FIG. 12 shows schematically the main components of one possible example of a system for filling containers, specifically, a beverage bottling plant for filling bottles 130 with at least one liquid beverage, in accordance with at least one possible exemplification, in which system or plant could possibly be utilized at least one aspect, or several aspects, of the exemplifications disclosed herein.

FIG. 12 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 12, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an exemplification is believed at the time of the filing of this patent application to possibly reside broadly in a cap-like closure system for containers, comprising a crown cork, which comprises a plurality of prong-like or tooth-like shaped ends, as the main part, formed at least partially from a metallic and/or aluminum-containing material, and comprising an inside and an outside intended for contact with the container, wherein the main part of the crown cork is formed in such a way that the shaped ends, after specific deformation for closing the container, form one or more hollow spaces between the outer container surface and the shaped ends, wherein a deformable sealing material is provided on the inside in the region of the shaped ends, which closes the hollow spaces at least in the circumference of the end facing the container base.

Another feature or aspect of an exemplification is believed at the time of the filing of this patent application to possibly reside broadly in the cap-like closure system, wherein the sealing material is a rubber-type or foam-type material, such as a rubber-type or foam-type material of which the outer surface comprises no or essentially no pores in relation to the inner surface.

Yet another feature or aspect of an exemplification is believed at the time of the filing of this patent application to possibly reside broadly in the cap-like closure system, wherein the sealing material is a material which is activatable in respect of the volume.

Still another feature or aspect of an exemplification is believed at the time of the filing of this patent application to possibly reside broadly in the cap-like closure system, wherein the sealing material can be activated by the application of energy, in one possible exemplification by thermal energy, in that it expands under the influence of heat.

A further feature or aspect of an exemplification is believed at the time of the filing of this patent application to possibly reside broadly in the cap-like closure system, wherein the sealing material exhibits a "memo" effect, and, after reduction by pressure, retains a compressed reduced volume form for a certain time, or, respectively, tries to regain the original enlarged volume form.

Another feature or aspect of an exemplification is believed at the time of the filing of this patent application to possibly reside broadly in the cap-like closure system, wherein the sealing material is one or more applications of a hot and/or melt adhesive.

Yet another feature or aspect of an exemplification is believed at the time of the filing of this patent application to possibly reside broadly in the cap-like closure system, wherein the sealing material projects radially outwards over the shaped ends.

Still another feature or aspect of an exemplification is believed at the time of the filing of this patent application to possibly reside broadly in the cap-like closure system, wherein the sealing material projects above the main part in the region of elevations on the inside perpendicularly or substantially perpendicularly or transverse by not more than one millimeter, in one possible exemplification by zero to one-half millimeter.

A further feature or aspect of an exemplification is believed at the time of the filing of this patent application to possibly reside broadly in the cap-like closure system, wherein the sealing material contains at least in certain areas a germ-inhibiting or germicidal substance.

Another feature or aspect of an exemplification is believed at the time of the filing of this patent application to possibly reside broadly in the cap-like closure system, wherein valley sections of the shaped ends on the outside of the main part are occupied at least partially with a filling material, and/or the outer edge of the main part is occupied by an edge material.

One feature or aspect of an exemplification is believed at the time of the filing of this patent application to possibly reside broadly in a method for the closure of containers with a cap-like closure system according to the present application, wherein the containers and the crown corks are conveyed to the closure device, wherein after the step of deformation of the shaped ends, an activation step follows, with which, indirectly by energy application into the crown cork or directly by energy application into free-lying surfaces of the sealing material, an at least intermittent change of form and/or state of the sealing material is incurred.

Another feature or aspect of an exemplification is believed at the time of the filing of this patent application to possibly reside broadly in the method, wherein the energy application takes place in a transport and/or handling station downstream of the closure device.

Yet another feature or aspect of an exemplification is believed at the time of the filing of this patent application to possibly reside broadly in the method, wherein the energy application takes place during a continuous transport of the containers.

Still another feature or aspect of an exemplification is believed at the time of the filing of this patent application to possibly reside broadly in the method, wherein the change of form and/or state of the sealing material takes place in such a way that, after the deformation and after the activation, projecting sealing material covers the free shaped ends radially, and therefore forms a ring or rim beneath the free shaped ends.

A further feature or aspect of an exemplification is believed at the time of the filing of this patent application to possibly reside broadly in the method, wherein the sealing material is adhesively bonded, pressed on, or secured in an otherwise suitable manner onto the main part of the crown cork, wherein the step of bringing together the sealing material and the main part takes place directly upstream or in the closure system, wherein the main part and the sealing material are provided from two different material-holding and storage units, and are conveyed via corresponding feed and transfer systems respectively to a combining unit, and are there combined before the application onto the respective container to form one single closure (crown cork).

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or useable in any one or more exemplifications of the application.

The sentence immediately above relates to patents, patent applications, patent publications, and other documents either incorporated by reference or not incorporated by reference.

The following patents, patent applications, patent publications, and other documents, except for the exceptions indicated herein, are hereby incorporated by reference as if set forth in their entirety herein except for the exceptions indicated herein: DE 401 81 21 A1, having the following English translation of the German title "Filling and closing bottles-involves mechanism which forms seal press seat between closure and bottle", published on Dec. 12, 1991; DE 1018121 A1, having the following German title "Freiluft-Hochspannungsverbundisolator aus Kunststoff", published on Oct. 24, 1957; DE 4036306 A1, having the following English translation of the German title "Fitting sealing caps to filled bottles", published on Jun. 4, 1992; and DE 35 15 334 A1, having the English translation of the German title "VESSEL CLOSING MACHINE", published on Oct. 30, 1986.

All of the patents, patent applications, patent publications, and other documents, except for the exceptions indicated herein, which were cited in the German Office Action dated Jul. 8, 2015, and/or cited elsewhere, as well as the German Office Action document itself, are hereby incorporated by reference as if set forth in their entirety herein except for the exceptions indicated herein, as follows: DE 10 2014 010 626 A1, having the German title "Verschluss einer Flasche mit einem Kronkorken", published on May 7, 2015; DE 10 2005 004 996 B3, having the English translation of the German title "Crown cap for bottles is produced by stamping from a metal sheet, with the seals laid in position, to give a base and a peripheral wall with a toothed structure", published on Jul. 20, 2006; and DE 40 36 306 A1, having the English translation of the German title "Fitting sealing caps to filled bottles", published on Jun. 4, 1992.

All of the patents, patent applications, patent publications, and other documents, except for the exceptions indicated herein, which were cited in the International Search Report dated Jun. 8, 2015, and/or cited elsewhere, as well as the International Search Report document itself, are hereby incorporated by reference as if set forth in their entirety herein except for the exceptions indicated herein, as follows: U.S. Pat. No. 2,974,816 A, having the title "Closing and sealing bottles and other receptacles", published on Mar. 14, 1961; U.S. Pat. No. 3,261,895 A, having the title "Method for manufacturing resin products including foam products", published on Jul. 19, 1966; DE 197 13 404 A1, having the following English translation of the German title "Anti-leakage closure for wine bottles", published on Oct. 8, 1998; and FR 1,317,228 A, having the French title "Joint stérilisateur pour bouteilles a liquides alimentaires", published on Feb. 8, 1963.

The corresponding foreign and international patent publication applications, namely, Federal Republic of Germany Patent Application No. DE 10 2014 104 322.7, filed on Mar. 27, 2014, having inventors Heinz HILLMANN and Andreas KRIEG, and DE-OS DE 10 2014 104 322.7 and DE-PS DE 10 2014 104 322.7, and International Application No. PCT/EP2015/056264, filed on Mar. 24, 2015, having WIPO Publication No. WO 2015 144710 A1 and inventors Heinz HILLMANN and Andreas KRIEG, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications, patent publications, and other documents, except for the exceptions indicated herein, are hereby incorporated by reference as if set forth in their entirety herein except for the exceptions indicated herein.

The purpose of incorporating the corresponding foreign equivalent patent application(s), that is, PCT/EP2015/056264 and German Patent Application 10 2014 104 322.7, is solely for the purposes of providing a basis of correction of any wording in the pages of the present application, which may have been mistranslated or misinterpreted by the translator, and to provide additional information relating to technical features of one or more exemplifications, which information may not be completely disclosed in the wording in the pages of this application.

Statements made in the original foreign patent applications PCT/EP2015/056264 and DE DE 10 2014 104 322.7 from which this patent application claims priority which do not have to do with the correction of the translation in this patent application are not to be included in this patent application in the incorporation by reference.

Any statements about admissions of prior art in the original foreign patent applications PCT/EP2015/056264 and DE 10 2014 104 322.7 are not to be included in this patent application in the incorporation by reference, since the laws relating to prior art in non-U.S. Patent Offices and courts may be substantially different from the Patent Laws of the United States.

U.S. patent application Ser. No. 15/277,360, filed on Sep. 27, 2016, having inventors Heinz HILLMANN and Andreas KRIEG, and title CROWN CAP AND LOSING DEVICE, and its corresponding Federal Republic of Germany Patent Application No. 10 2014 104 316.2, filed on Mar. 27, 2014, and International Patent Application No. PCT/EP2015/056263, filed on Mar. 24, 2015, having WIPO Publication No. WO 2015/144709 A1—and inventors Heinz HILLMANN and Andreas FAHLDIECK are hereby incorporated by reference as if set forth in their entirety herein.

U.S. patent application Ser. No. 15/277,018, filed on Sep. 27, 2016, having inventors Heinz HILLMANN and Andreas KRIEG, and title CROWN CAP CLOSURE AND CLOSURE METHOD, and its corresponding Federal Republic of Germany Patent Application No. 10 2014 104 323.5, filed on Mar. 27, 2014, and International Patent Application No. PCT/EP2015/056266, filed on Mar. 24, 2015, having WIPO Publication No. WO 2015/144711 and inventors Heinz HILLMANN and Andreas FAHLDIECK are hereby incorporated by reference as if set forth in their entirety herein.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

What is claimed is:

1. A container closure structure comprising:

a metallic crown cork comprising a disc-shaped main portion and a substantially ring-shaped, corrugated edge portion;

said edge portion being disposed at an angle to said main portion and to surround said main portion;

said edge portion comprising a plurality of projections, which projections form alternating peak portions and valley portions;

upon installation of said crown cork on a container, a first section of an inside surface of said edge portion being in contact with the container, and a second section of said inside surface of said edge portion being disposed a distance from said container with hollow spaces therebetween; and a deformable sealing material being disposed at an edge of said edge portion furthest from said main portion and not extending to an outside surface of said edge portion, and on only a portion of said second section of said inside surface of said edge portion, to seal and close off said hollow spaces from the outside environment, which hollow spaces are disposed axially between said main portion and said sealing material.

2. The container closure structure according to claim 1, wherein said sealing material comprises a thickness that varies about the length thereof.

3. The container closure structure according to claim 2, wherein:

the container closure structure has a central axis;

said second section of said inside surface of said edge portion comprises alternating inside peak surface portions and inside valley surface portions;

said inside peak surface portions are disposed further away from the central axis, in a radial direction, than said inside valley surface portions, such that, upon installation of said crown cork on a container, said inside peak surface portions are disposed further away from the outer surface of the container than said inside valley surface portions; and the thickness of said sealing material is thicker on said inside peak surface portions than on said inside valley surface portions.

4. The container closure structure according to claim 3, wherein the thickness of said sealing material on said inside valley surface portions is at most one millimeter.

5. The container closure structure according to claim 3, wherein the thickness of said sealing material on said inside valley surface portions is at most 0.5 millimeter.

6. The container closure structure according to claim 3, wherein the thickness of said sealing material on said inside valley surface portions is less than 0.2 millimeter.

7. The container closure structure according to claim 3, wherein the thickness of said sealing material on said inside valley surface portions is sufficiently small to minimize shearing of said sealing material upon installation of said crown cork on a container.

8. The container closure structure according to claim 3, wherein said sealing material contains a germ-inhibiting or germicidal substance.

9. The container closure structure according to claim 3, wherein:

the container closure structure comprises a top seal disposed on said main portion and configured to seal a top edge or lip of a container; and said sealing material being separate and disposed a distance from said top seal.

10. The container closure structure according to claim 3, wherein, upon installation of said crown cork on a container, said sealing material contacts the container only at a section of said mouth portion of the container below a lip portion of the container.

11. The container closure structure according to claim 1, wherein:

said sealing material is a rubber-type or foam-type material; and the outer surface of said rubber-type or foam-type material comprises no or essentially no pores in relation to the inner surface of said rubber-type or foam-type material.

12. The container closure structure according to claim 1, wherein said sealing material is a material which is activatable in respect of the volume.

13. The container closure structure according to claim 12, wherein said sealing material is a material which is activatable by the application of energy.

14. The container closure structure according to claim 12, wherein said sealing material is a material which is activatable by the application of thermal energy to expand said sealing material.

15. The container closure structure according to claim 12, wherein said sealing material exhibits a memory effect, and, after reduction by pressure, retains a compressed reduced volume form for a certain time, or, respectively, tries to regain the original enlarged volume form.

16. The container closure structure according to claim 1, wherein said sealing material comprises one or more applications of a hot and/or melt adhesive.

17. The container closure structure according to claim 1, wherein said sealing material projects radially outwards past said edge portion.

* * * * *